US007677175B2

(12) United States Patent
Gretsch

(10) Patent No.: US 7,677,175 B2
(45) Date of Patent: Mar. 16, 2010

(54) INSTALLATION FOR CHANGING INK IN A PRINTING STATION OF A FLEXOGRAPHIC PRINTER

(75) Inventor: Pierre Gretsch, Valeyres-sous-Ursins (CH)

(73) Assignee: Bobst S.A. (CH)

( * ) Notice: Subject to any disclaimer, the term of this patent is extended or adjusted under 35 U.S.C. 154(b) by 39 days.

(21) Appl. No.: 12/066,354

(22) PCT Filed: Sep. 13, 2006

(86) PCT No.: PCT/EP2006/008914

§ 371 (c)(1),
(2), (4) Date: Jun. 10, 2008

(87) PCT Pub. No.: WO2007/031293

PCT Pub. Date: Mar. 22, 2007

(65) Prior Publication Data

US 2009/0020030 A1 Jan. 22, 2009

(30) Foreign Application Priority Data

Sep. 13, 2005 (EP) ..... 05019937.1

(51) Int. Cl.
*B41F 33/00* (2006.01)

(52) U.S. Cl. ..... 101/483; 101/425

(58) Field of Classification Search ..... 101/423, 101/425, 483

See application file for complete search history.

(56) References Cited

U.S. PATENT DOCUMENTS 4,774,884 A 10/1988 Sugimoto et al.
4,967,664 A * 11/1990 Iijima ..... 101/423
5,213,044 A * 5/1993 Elia et al. ..... 101/483
5,564,338 A 10/1996 Branas et al.
5,967,044 A * 10/1999 Marschke ..... 101/363
6,530,323 B2 * 3/2003 Bardet et al. ..... 101/480
6,857,367 B2 * 2/2005 Heller et al. ..... 101/483
2004/0123758 A1 7/2004 Shields
2005/0103217 A1 5/2005 Biasini

FOREIGN PATENT DOCUMENTS

EP 0 687 563 12/1995
EP 0 970 810 1/2000
EP 1 195 246 4/2002
GB 1 091 878 11/1967

OTHER PUBLICATIONS

International Search Report and Written Opinion in English dated Feb. 2, 2007 issued in corresponding Int'l Application No. PCT/EP06/008914.

International Search Report and Written Opinion in French dated Feb. 2, 2007 issued in corresponding Int'l Application No. PCT/EP06/008914.

* cited by examiner

*Primary Examiner*—Anthony H. Nguyen
(74) *Attorney, Agent, or Firm*—Ostrolenk Faber LLP

(57) ABSTRACT

A method and an installation operable for cleaning an inking blade acting against a chambered printing cylinder of a flexographic printing machine. A cleaning device includes a blade cleaner, a recovery device for ink removed from the blade, a first prewash cleaning system, a subsequent regular wash system and an air nozzle system to clean out ink. The ink is recovered before the washing. The ink washed out is recovered and this polluted wash fluid is used in a subsequent cleaning as a prewash.

9 Claims, 8 Drawing Sheets

INSTALLATION FOR CHANGING INK IN A PRINTING STATION OF A FLEXOGRAPHIC PRINTER

CROSS REFERENCE TO RELATED APPLICATIONS

Figure 1:
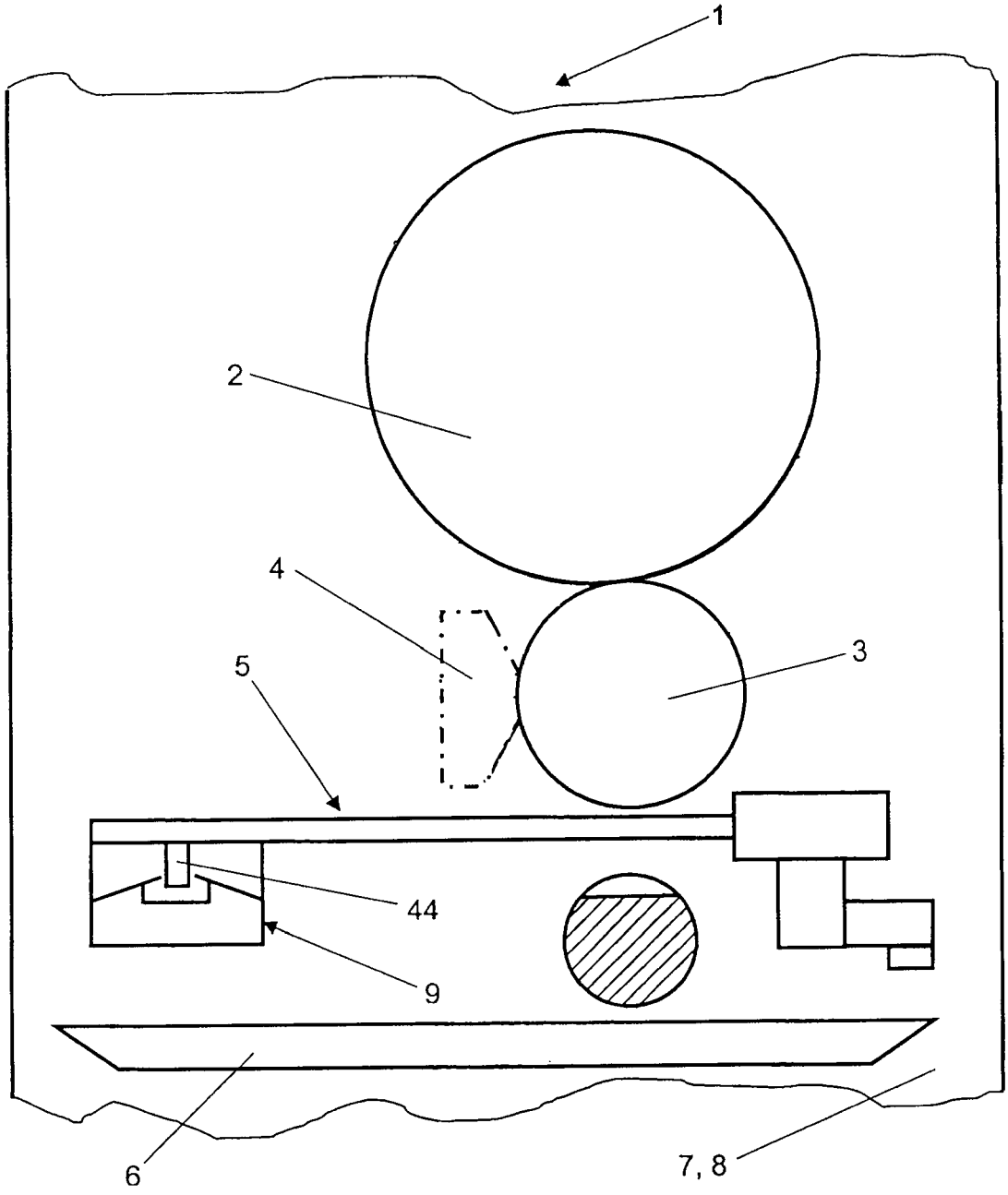

The present application is a 35 U.S.C. §§ 371 national phase conversion of International Application PCT/EP2006/008914, filed Sep. 13, 2006, which claims priority of European Patent Application No. 05019937.1, filed Sep. 13, 2005, the disclosures of which have been incorporated herein by reference. The PCT International Application was published in the French language.

BACKGROUND OF THE INVENTION

The present invention relates to an installation for changing ink in a printing station of a flexographic printer.

Known installations intended for changing ink in the various printing units of a flexographic printing machine usually comprise means for cleaning various inking members coupled with means to refill the inking circuit, usually with an ink of another color. Presently, cleaning the printing members of flexographic printing machines is done in a manner familiar to practitioners, by circulating water through the piping of the inking circuit and through the chambered doctor blade, using the ink pump. This cleans all the inking members as well as the screened ink transfer cylinder. However, some of the inking members, in particular the chambered doctor blade, need the most perfect cleaning possible to avoid mixing new ink with residues of ink color previously used. This cleaning operation makes use of a very large quantity of cleaning fluid, usually water.

DESCRIPTION OF THE PRIOR ART

European Patent EP-B-0,687,563 describes in detail a cleaning device, which washes the inking members of such a printing machine. This device makes cleaning operations easier by suppressing any manual cleaning of the printing members of the rotary printing machine. But, the problem of reducing the quantity of cleaning fluid is not solved, because to have acceptable cleaning, it is necessary to perform a great number of runs of the cleaning device over the chambered doctor blade. This causes very high consumption of cleaning fluid. Independently of that, residual ink contained in the various inking piping is also to be eliminated.

SUMMARY OF THE INVENTION

The object of the present invention is to change ink in a printing unit of a flexographic printing machine, including cleaning of the chambered doctor blade to allow better elimination of the ink remaining in the chambered doctor blade before the cleaning fluid is used up.

This object is achieved by using a method and an installation operable for cleaning the inking blade acting against the chambered printing cylinder of a flexographic printing machine. A cleaning device includes a blade cleaner, a recovery device for ink removed from the blade, a first prewash cleaning system, a subsequent regular wash system and an air nozzle system to clean out ink. The ink is recovered before the washing. The ink washed out is recovered and the polluted wash fluid is used in a subsequent cleaning as a prewash.

BRIEF DESCRIPTION OF THE INVENTION

Figure 2:
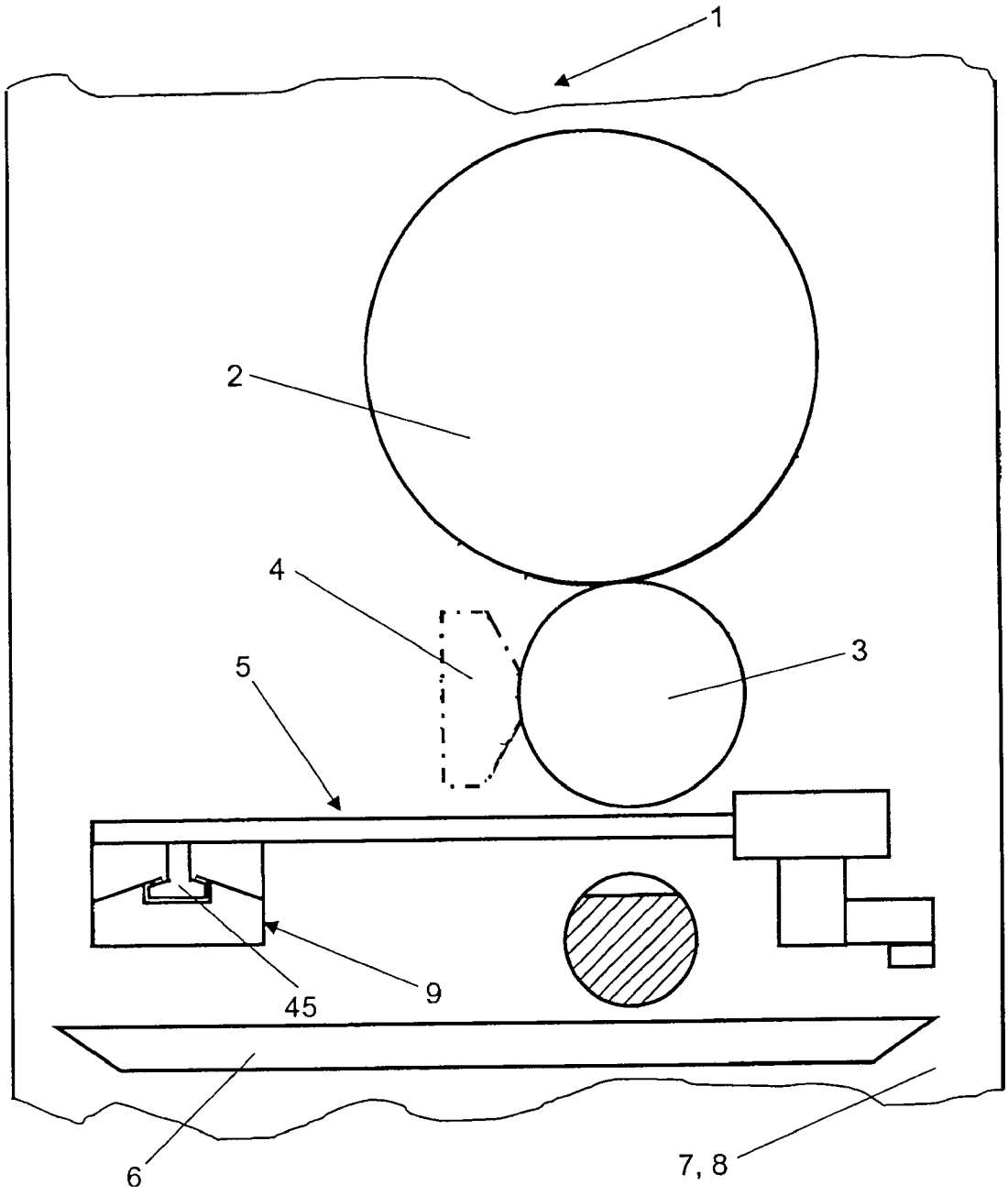
Figure 3:
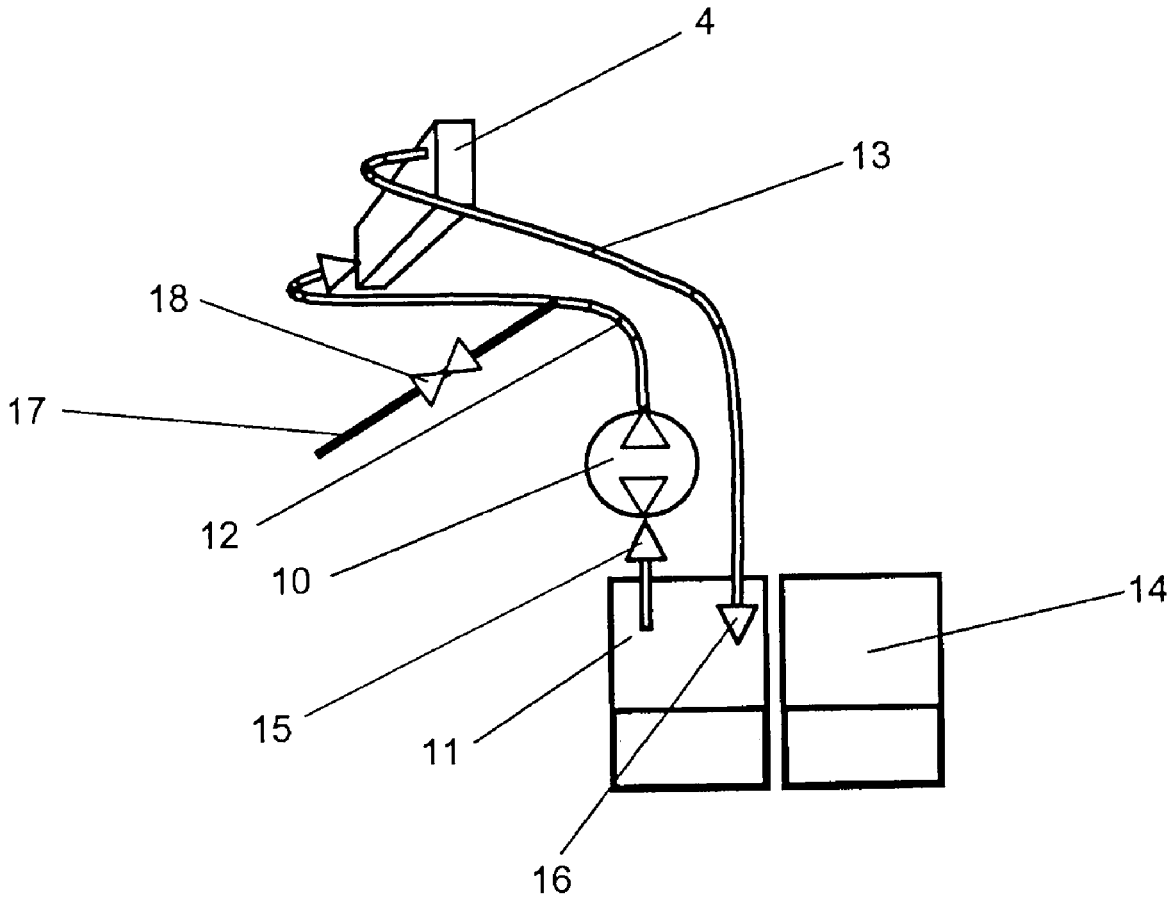
Figure 4:
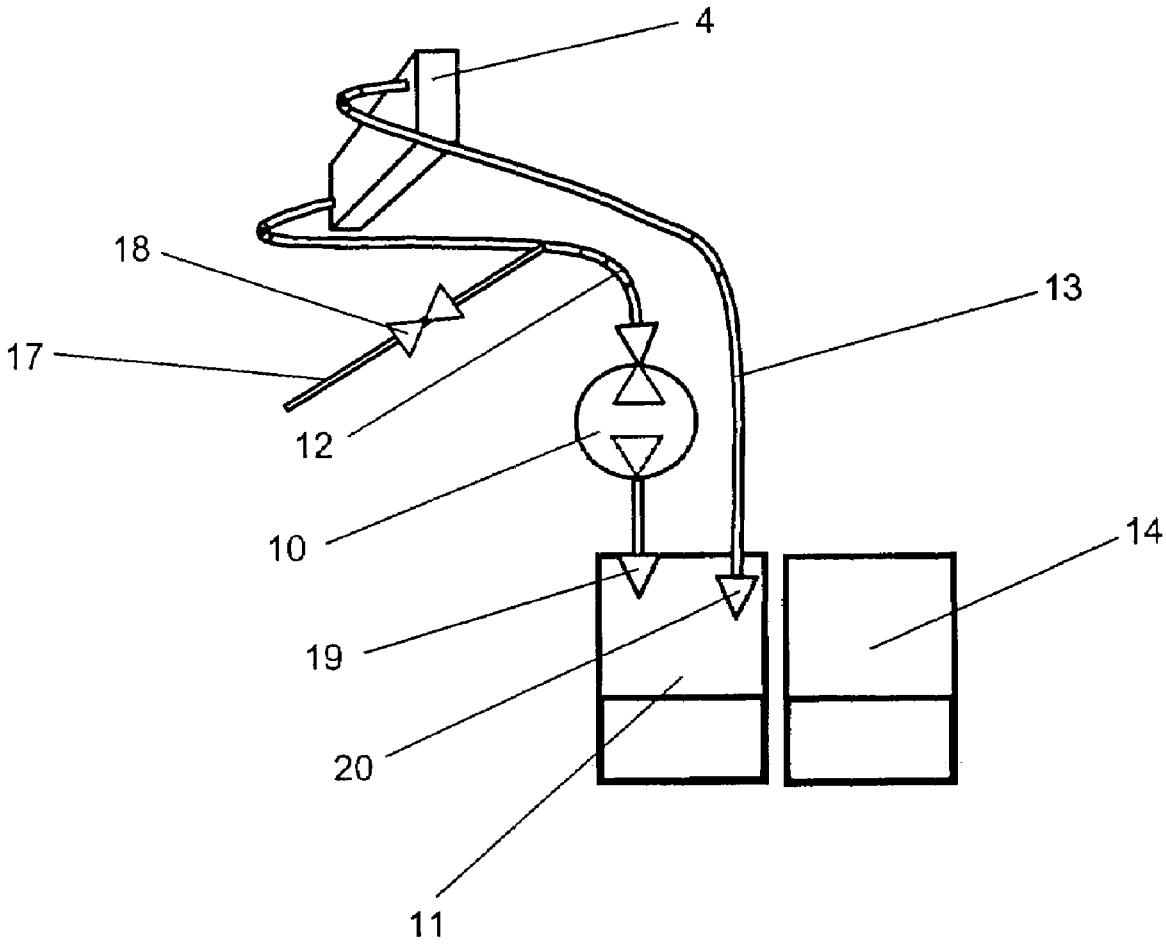
Figure 5:
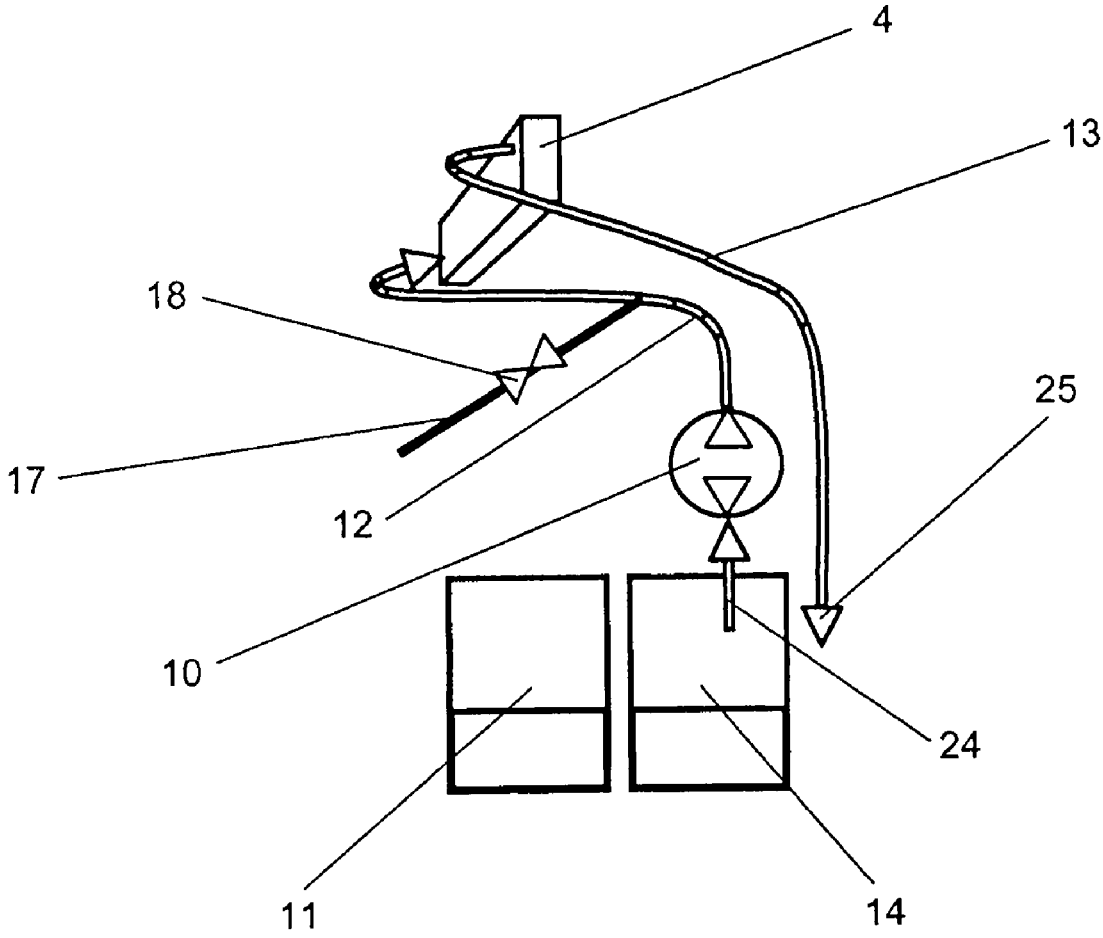
Figure 6:
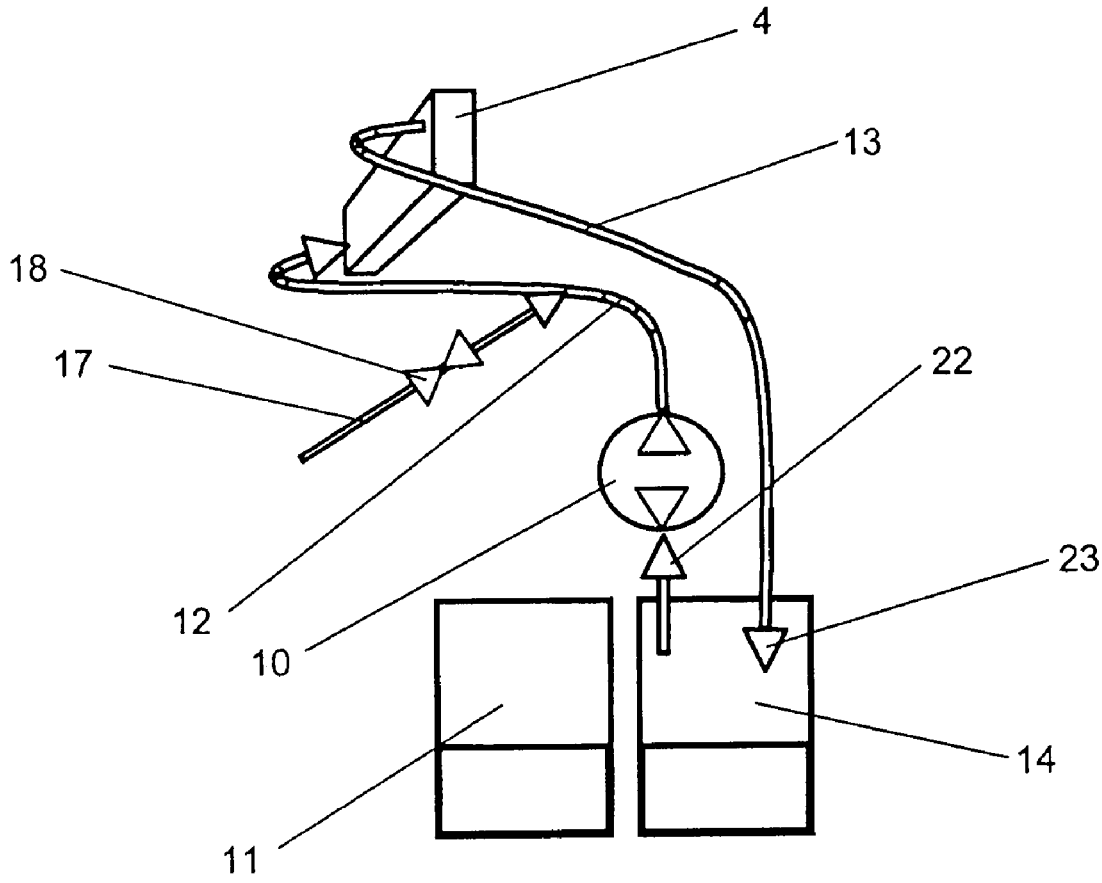
Figure 7:
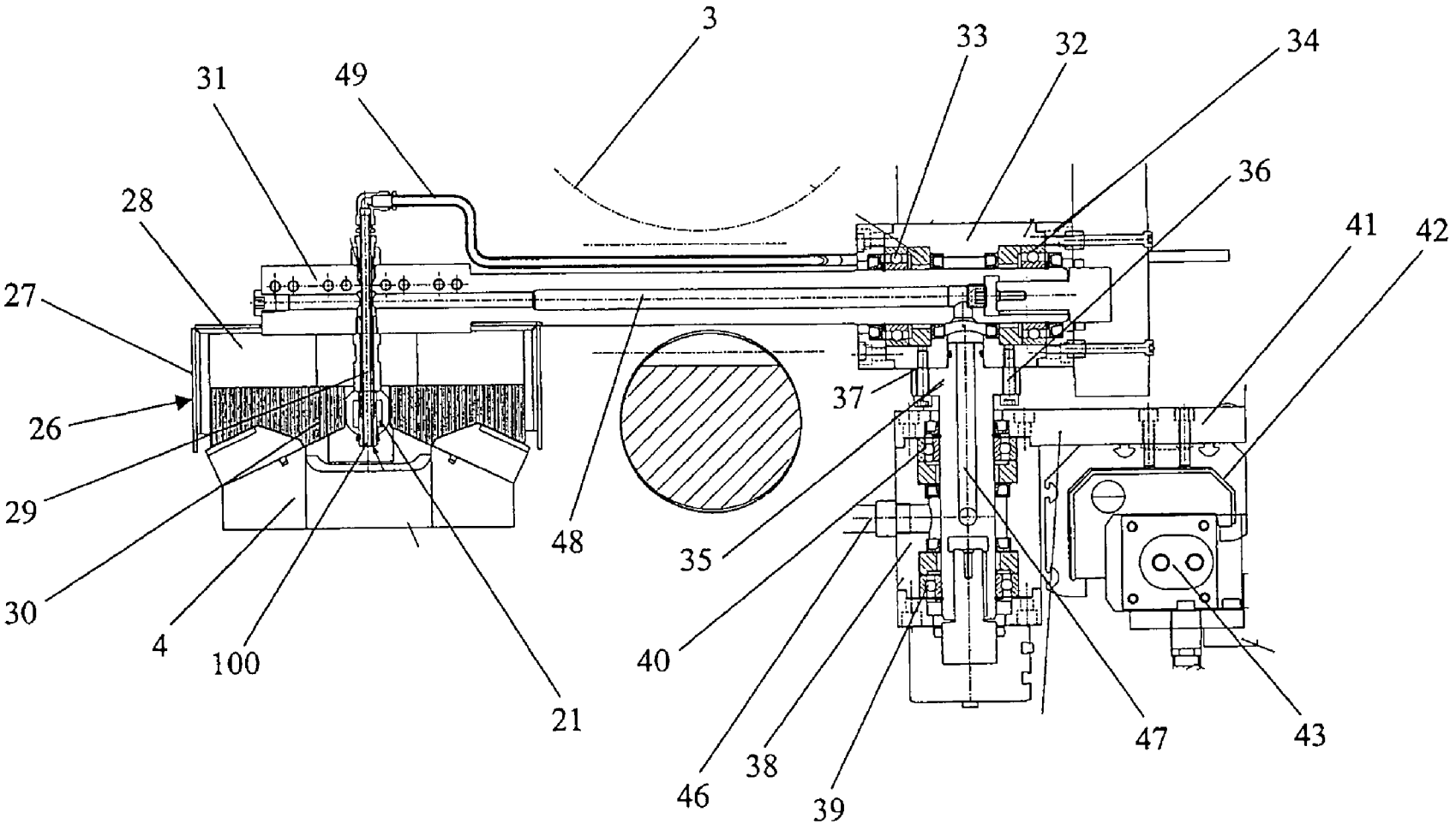
Figure 8A:
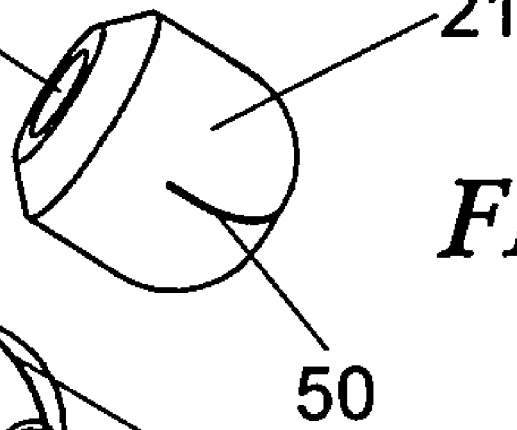
Figure 8B:
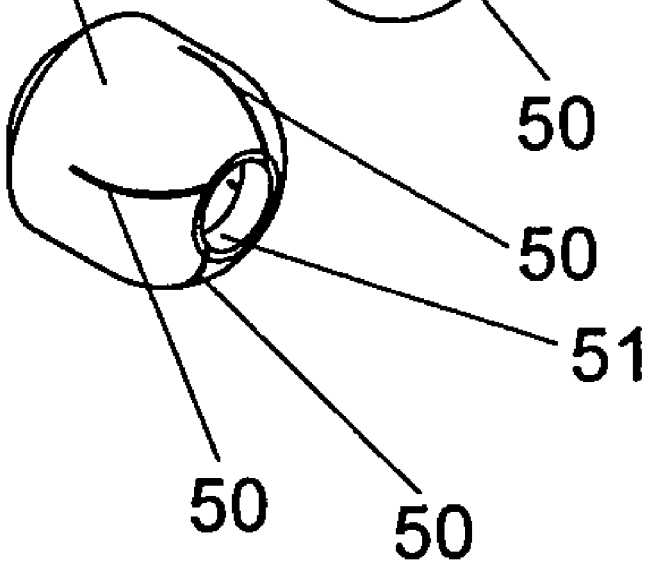

The invention is now described with reference to a non-limiting embodiment and is illustrated in the appended drawings in which:

FIG. 1 is a schematic view in partial section of a first version of a cleaning installation of an inking unit of a flexographic printing machine, FIG. 2 is a schematic view, in partial section of a second version of a cleaning installation of the inking unit of a flexographic printing machine, FIG. 3 is a schematic view showing the inking of a chambered doctor blade, FIG. 4 is a schematic view, showing ink recovery from a chambered doctor blade, FIG. 5 is a schematic view, showing prewashing of the chambered doctor blade with a dirty cleaning fluid which has been recovered from a previous cleaning, FIG. 6 is a schematic view, showing the cleaning of the chambered doctor blade with a clean cleaning fluid, FIG. 7 is a section view of the washing member of the chambered doctor blade and, FIGS. 8A and 8B are each sectional views of the rotary nozzle of the washing member of FIG. 7.

DESCRIPTION OF THE PREFERRED EMBODIMENTS

FIG. 1 is a schematic view in partial section of the inking unit of a flexographic printing machine. This printing unit 1 comprises a plate cylinder 2, which is inked by a celled cylinder 3, known by practitioners as an anylox cylinder. This celled cylinder 3 is fed with ink by a chambered doctor blade 4, represented here by mixed dashed lines in its inking position. The inking unit 1 also comprises a cleaning device 5 for the inking means, that is for the celled cylinder 3 and the chambered doctor blade 4. The cleaning device 5 is described below in detail with reference to FIG. 7. A recovery container 6 is arranged under the inking members near the cleaning device 5. The inking members extend between two side frames 7, respectively 8. The chambered doctor blade 4 is connected to two levers, not represented, to allow the blade to pivot from its inking position to a cleaning position depicted here by the reference 9. In this implementation, the cleaning device 5 comprises a recovery member 44 operable for recovering the ink contained in the chambered doctor blade. The device 5 is comprised of a rotary nozzle 21 coupled to a stationary nozzle 100 (see FIG. 7).

FIG. 2 is a schematic view in partial section of a second version of a cleaning installation of the inking unit of a flexographic printing machine. In this version, the inking unit 1 comprises a plate cylinder 2 which is inked by a celled cylinder 3, known by practitioners as an anylox cylinder. This celled cylinder is fed ink by a chambered doctor blade 4, represented here by mixed dashed lines in its inking position. The inking unit 1 also comprises a cleaning device 5 for the inking members, that is, for the celled cylinder 3 and the chambered doctor blade 4. A recovery container 6 is arranged under the inking members near the cleaning device 5. The inking members extend between two side frames 7, respectively 8. The chambered doctor blade 4 is connected to two levers, not represented, to allow it to pivot from its inking position to a cleaning position depicted here by the reference 9. In this implementation, the cleaning device 5 includes a recovery member 45 for recovery of the ink contained in the chambered doctor blade. The cleaning device is comprised of an ink knife having a shape closely matching the inside profile of the chambered doctor blade 4, so as to be able to recover as much as possible of the ink in the chambered doctor blade 4. This solution allows a mechanical recovery of the ink contained in the chambered doctor blade during movement of the ink knife along the chambered doctor blade 4.

FIG. 3 is a schematic view representing inking of the chambered doctor blade 4 which is in contact at this stage of process with the celled cylinder 3. For this operation, the installation for changing ink comprises a bi-directional pump 10. It is brought near an ink storage 11 so as to be able to feed the chambered doctor blade 4 with ink via a supply piping 12. The bi-directional pump 10 pushes the ink in the supply piping 12 in the direction indicated by the arrow 15. The inking circuit of the chambered doctor blade comprises a return piping 13 linking the chambered doctor blade to the ink storage 11, for ink return in the direction indicated by the arrow 16. A supply piping 17 for the cleaning fluid is linked to the piping 12 supplying ink to the chambered doctor blade 4. This supply piping 17 of the cleaning fluid is fitted with a valve 18 which is in a closed position during feeding of ink to the chambered doctor blade 4. The installation for changing ink also comprises means to move the piping 13, automatically in due course, over a recovery tank 14 for the cleaning fluid as explained below.

FIG. 4 is a schematic view representing ink recovery from the chambered doctor blade. To prepare for a new job requiring an ink of a different color in the printing units of the machine, the operator proceeds with cleaning of the printing members. For that, it is necessary to first recover the ink contained in the chambered doctor blade 4. This operation is performed with the chambered doctor blade in its inking position, i.e. with the chambered doctor blade 4 in contact with the celled cylinder 3, as represented in FIGS. 1 and 2. The pumping direction of the bi-directional pump is reversed with respect to the direction earlier indicated by the arrow 15, to supply ink from the chambered doctor blade 4 to the ink storage 11 in the direction indicated by the arrow 19 in FIG. 4. The ink contained in the back piping 13, partly in the chambered doctor blade 4 is also supplied by gravity to the ink storage 11 in the direction indicated by the arrow 20. After the ink contained in the chambered doctor blade 4 has been removed, some ink marks still remain in the chambered doctor blade 4. It is desirable to eliminate these ink residues. For that purpose, the chambered doctor blade 4 is pivoted into the cleaning position 9 (see FIG. 1). The cleaning device 5 is brought over the chambered doctor blade 4 and, for a first time, the stationary nozzle 100 at the rotary nozzle 21 (see FIG. 7), is fed with gaseous fluid, for example compressed air, and is moved along the chambered doctor blade in order to force the residual ink remaining in the chambered doctor blade 4 to flow out of the blade and into the ink storage 11, alternately by the back piping 13 and by the supply piping 12. The blowing operation on the residual ink can be repeated several times, as a function of the chosen cleaning program.

FIG. 5 is a schematic view representing prewashing of the chambered doctor blade with a dirty washing fluid that had been recovered from a preceding washing, for example the one described in relation to the FIG. 6. The valve 18 is closed. Polluted washing fluid then in the recovery tank 14 is pushed into the chambered doctor blade 4 by the bi-directional pump 10 in the direction indicated by the arrow 24, and this pushes the polluted washing fluid to the factory wastewater treatment station using pressure and through the back piping 13, in the direction indicated by the arrow 25. After this prewashing operation, washing of the chambered doctor blade 4 can thus proceed, such as by the process described in relation to FIG. 6.

FIG. 6 is a schematic view representing the washing of the chambered doctor blade with a clean washing fluid. After the operation described in relation to FIG. 5 has finished, the feeding of compressed air has been stopped, the rotary nozzle 21 of the washing means is fed with clean washing fluid, and the nozzle is moved again along the chambered doctor blade 4, still in washing position, so as to be able to rinse the inside of the chambered doctor blade 4 with washing fluid. As thus represented in FIG. 6, the installation for changing ink has been moved to be positioned at the recovery tank 14 of the washing fluid. The valve 18 of the supply piping 17 of the cleaning fluid 17 is opened and the bidirectional pump 10 is actuated to push this washing fluid in the direction indicated by the arrow 22, in the direction of the chambered doctor blade 4. The return of the washing fluid in the direction of arrow 23 is assured using the back piping 13. This operation lasts as long as necessary to completely eliminate all the ink residues from the inking circuit. The valve 18 is then closed, and the polluted washing fluid is stored in the recovery tank 14, available for a subsequent prewashing use in the chambered doctor blade 4. This process allows use of this polluted washing fluid during a further washing operation of the chambered doctor blade. The prewashing of the chambered doctor blade saves a significant quantity of clean washing fluid by starting the cleaning operation using this polluted fluid instead of starting with a clean washing fluid which is also to be used afterwards.

The installation for changing ink comprises also standard means to clean the other inking members, such as means mentioned in the preamble of the present patent application in relation with the European patent EP-B-0,687,563.

FIG. 7 is a cross-sectional view of a cleaning device 5 for a chambered doctor blade 4 according to the version represented by FIG. 1. This cleaning device 5 comprises a washing head 26 formed by a box 27 comprising a sole plate 28 crossed by a supply piping 29 for supplying a cleaning fluid and compressed air to the rotary nozzle 21 and the stationary nozzle 100. The sole plate 28 is fitted with a brush 30 which has bristles preferably perfectly matched to the outside profile of the chambered doctor blade 4. The washing head 26 is arranged so as to be able to pivot from a horizontal position to a contact position with the chambered doctor blade 4. The washing head 26 is mounted at one end of an arm 31. The other end is pivotably mounted in a bearing 32, in particular comprising ball bearings 33 and 34. A spindle 35 is attached at the lower portion of the bearing 32 by mean of screws 36 and 37. The spindle 35 is mounted on ball bearings 39 and 40 so as to be able to pivot in a block-bearing 38, thus allowing horizontal rotation of the arm 31 supporting the washing head 26. The block-bearing 38 is connected to a support 41 having one end attached on a carriage 42, which is able to transversely move along the chambered doctor blade 4 under the action of a pneumatic cylinder 43 or of another similar member. Feeding of cleaning fluid to the rotary nozzle 21 is through the piping 46 for injecting the cleaning fluid up to the rotary nozzle 21 through the boring 47 of the spindle 35 emerging in the boring 48 provided in the arm 31. Feeding of the stationary nozzle 100 and of the rotary nozzle 21 with compressed air is ensured via the pipe 49. Rotation of the rotary nozzle 21 around the piping 29 occurs under the action of cleaning fluid ejected through the slots 50 of the rotary nozzle 21 (see FIG. 7). After the cleaning operations of the chambered doctor blade 4 have been completed, the washing head 26 is pivoted so as to disengage it from the chambered doctor blade, and the arm 31 is pivoted on the spindle 35 in a manner to bring the cleaning member 5 in an out of work position allowing the chambered doctor blade 4 to pivot to bring it into contact with the celled cylinder 3 to re-feed the chambered doctor blade 4 with an ink of a different color.

FIGS. 8A and 8B are views of the rotary nozzle 21 of the cleaning device 5 of FIG. 7. The rotary nozzle is represented in two different positions so as to show the positioning of the slots 50 around the rotary nozzle 21. The slots 50 have a particular shape so that the action of the cleaning fluid causes the rotary nozzle 21 to move around the piping 29 (see FIG. 6) passing through the boring 51 of the rotary nozzle 21.

A benefit provided by the present invention is mainly the saving of cleaning fluid due to the fact of the recovery of polluted cleaning fluid in the recovery tank 14, to use it afterwards as prewashing fluid for the chambered doctor blade 4 and in a more full recovery of the ink remaining in the chambered doctor blade. A washing cycle begins by first using polluted fluid and afterwards using clean fluid.

Numerous improvements can be brought to the present invention within the scope of the claims.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A method for changing ink in a printing unit of a flexographic printing machine, comprising providing a cleaning device for cleaning inking members which include a celled cylinder and a chambered doctor blade operable against the cylinder;

the method comprising mechanically recovering residual ink remaining in the chambered doctor blade by moving an ink knife matching an inside profile of the chambered doctor blade along the inside profile;

washing the chambered doctor blade with cleaning fluid;

recovering the polluted cleaning fluid in a recovery tank for use in a subsequent prewashing of the chambered doctor blade; and then washing the chambered doctor blade with a clean cleaning fluid.

2. An installation for changing ink in a printing unit of a flexographic printing machine, comprising a cleaning device for cleaning inking members, the cleaning device including a celled cylinder and a chambered doctor blade operable against the cylinder, wherein the cleaning device for the chambered doctor blade comprises a washing head fitted with a rotary nozzle and a stationary nozzle aimed at the blade where the blade is operable against the cylinder, a connection to the rotary nozzle for feeding cleaning liquid therethrough and another connection to the stationary nozzle or to both of the stationary and rotary nozzles for feeding air or gaseous fluid therethrough the nozzles are fed with cleaning; and cleaning device further comprising a brush for cleaning ink from the blade.

3. The installation according to claim 2, further comprising an arm on which the washing head is pivotally mounted.

4. The installation according to claim 3, wherein the arm is mounted on a spindle operable for allowing rotation of the arm on the spindle in a horizontal path.

5. The installation according to claim 4, wherein the spindle is mounted in a block-bearing connected to a support fastened to a carriage for being guided transversely to and along a part of the blade that contacts the cylinder.

6. The installation according to claim 5, further comprising a guide for moving the carriage transversely.

7. The installation according to claim 3, wherein the arm and the spindle include borings operable for allowing the cleaning fluid to arrive at the rotary nozzle.

8. The installation according to claim 2, further comprising piping operable for feeding gaseous fluid to the stationary nozzle and for ejecting the gaseous fluid through the stationary nozzle, wherein the stationary nozzle in near the center of the rotary nozzle.

9. The installation according to claim 2, wherein the rotary nozzle includes slots arranged for causing the rotary nozzle to rotate under the action of ejected cleaning fluid.

* * * * *